United States Patent [19]

Wolper, Jr.

[11] Patent Number: 4,930,752

[45] Date of Patent: Jun. 5, 1990

[54] HIGHWAY FENCING

[76] Inventor: John F. Wolper, Jr., 395 First Ave., Phoenixville, Pa. 19460

[21] Appl. No.: 297,293

[22] Filed: Jan. 13, 1989

[51] Int. Cl.[5] ..... E01F 15/00

[52] U.S. Cl. ..... 256/13.1; 256/24; 256/45

[58] Field of Search ..... 256/24, 25, 26, 27, 256/28, 29, 30, 31, 45, 73, 13.1

[56] References Cited

U.S. PATENT DOCUMENTS

| | | | |
|---|---|---|---|
| 317,344 | 5/1885 | Hammond | 256/23 |
| 3,385,567 | 5/1968 | Case et al. | 256/24 |
| 3,770,245 | 11/1973 | Murdock | 256/24 |
| 3,799,506 | 3/1974 | Schwartz | 256/24 |
| 4,071,223 | 1/1978 | Demarest | 256/1 |
| 4,083,535 | 4/1978 | Britt | 256/24 |
| 4,193,584 | 3/1980 | Wieser | 256/24 X |
| 4,306,631 | 12/1981 | Reusser | 256/24 X |
| 4,369,953 | 1/1983 | Gretner et al. | 256/24 |

*Primary Examiner*—Randolph A. Reese
*Assistant Examiner*—J. Russell McBee
*Attorney, Agent, or Firm*—Laurence Weinberger
Lipton & Famiglio

[57] ABSTRACT

The screening or security fence structure of this invention includes a plurality of spaced I-beam vertical support posts with standardized fence panels placed between them. While each fence panel is securely mounted to the I-beam posts, it is also firmly and contiguously connected through the posts to adjacent panels, so that the entire fence structure is linked together. By this configuration, an impact force on one of the fence panels is distributed along the fence. Additionally, the vertical side members of each fence panel frame abut the inside surfaces of the I-beam posts. If a fence panel is struck by a moving vehicle, the vertical frame member will jam against the I-beam flanges thus preventing the fence panel from breaking away and causing a safety hazard.

Additionally, the fence fabric mounting hardware is secured within the I-beam channels thus reducing possible vandalism. In an alternative embodiment, a cable may be run the length of the fence inside the horizontal fence panel frame members. The cable prevents the panels from being removed and also further serves to distribute any impact force along the fence. Panels may be stacked vertically to achieve greater height.

17 Claims, 5 Drawing Sheets

HIGHWAY FENCING

BACKGROUND OF THE INVENTION

1. Field of the Invention

This invention relates to fence structures and more particularly to fences which are meant to restrain or prohibit the passage of human beings onto highways or over the side of bridges.

2. Description of Related Art

The fences placed along highways and over bridges to restrain human movement are subject to a variety of destructive forces. Most frequently, the fences are struck by moving vehicles. Unlike the typical guard rail fencing which is principally designed for impact, the open screening typically used in restraint fencing and the lighter weight of the upright posts usually results in structural failure of the fence under the force of even a modest impact. Often the fence components themselves become a further danger to nearby persons or vehicles as they hurl through the air after an impact.

A typical prior art screening fence consists of a fence panel section containing the restraint fabric which is attached to upright posts spaced at even intervals. Usually the upright posts are solid or hollow square bars or tubes onto which mounting plates have been attached either by welding or with bolts. The fence panel sections are attached to the mounting plates by bolts. When hit, this type of fence design usually fails at the mounting plate weld or attachment which is substantially weaker than the structural upright.

Another problem encountered with screening fence is the persistence of vandals in creating their own passageway through the fence. Usually the bolts fastening the fabric to the fence panel frame sections are removed by the vandals thereby permitting the fabric to be bent back. The replacement of the fabric and bolts can be a costly and time consuming maintenance task, especially since most screening fences are custom made to size rather than being assembled from stock components. This custom design also contributes to the frequency with which fences are given their final protective coating against the elements on site after they are erected.

Many alternative designs are known in the prior art for constructing highway screening and other types of fencing. No design is known which anticipates the combination of features of the present invention. For instance, U.S. Pat. No. 4,083,535 by Britt teaches a portable fence assembly in which the individual fence panels have wheels attached to the end members which fit into receiving channels in the upright support posts. U.S. Pat. No. 3,385,567 by Case and Belcher discloses a fence in which an upper frame member mounted in channels in the upright posts supports a web which rests directly on the support costs to suspend the panel arrangement. In U.S. Pat. No. 3,799,506 Schwartz teaches the use of fence panels mounted between upright slotted posts in an aluminum imitation of a woven wood fence. However, the end rails of the panel sections are slidably mounted within the top and bottom rails of each fence section so that they may be tensioned against the next panel in line mounted on the opposite side of the support cost. The fence sections are actually secured to each other with no tension being applied to the support posts.

In U.S. Pat. No. 4,193,584 Wieser discloses a livestock fence in which the concrete panels making up each fence section are held in vertical slots between concrete posts with the weight of each concrete panel resting on the ground. Restraining straps keep the concrete panels in place when jostled by the animals. U.S. Pat. No. 3,770,245 by Murdock teaches a fence assembly in which the fence panels are mounted on the support posts by a type of tongue and groove arrangement. In U.S. Pat. No. 4,306,631 Reusser teaches the use of I-beams for the vertical support posts. However, the interlocking vertical panels of his fence are secured to the opposite ends or flanges of the I-beam to form a staggered arrangement of panels. Finally, U.S. Pat. No. 4,071,223 by Demarest demonstrates a method of using vertical I-beams to support top and bottom horizontal rails which are mounted to the I-beams by angel brackets. Vertical strips are then fastened to the horizontal rails to fill in the fence.

BRIEF SUMMARY OF THE INVENTION

The fence design of the present invention employs standard and commercially available fence panel sections. These sections typically consist of fence panels with a rigid frame constructed from square, rectangular, three sided channel, or round metal tubing. Between the four sides of the frame, various fabric materials are stretched to form the barrier. The fence panels are mounted within the U shaped grooves formed by the flanges and webb of I-beams which are used for the vertical supports. The I-beams are oriented so that the open grooves face along the length of the fence. The fence panels are connected to each other and to the I-beams by bolts extending between the vertical frame members of adjacent panels through the central section (webb) of the I-beam.

The use of an I-beam as a vertical support post presents several advantages. First, no external mounting plate is required with which to attach the fence panels. This eliminates the weakest point in the prior art fence structures. Second, if the fence is struck by a moving vehicle, the I-beam flanges constrain the fence panel vertical frame members and help prevent the fence panel from breaking away and possibly causing further injury. Third, the combined strength against impact deformation of the combination of the I-beam coupled to the vertical frame members of adjacent panels is virtually the same as for a solid bar of the same dimensions but with much less weight and cost. Fourth, since the vertical frame members of the fence panels are contained within the U-shaped groove defined by the flanges and webb of the I-beam, the fastening hardware which is used to attach the fabric to the vertical frame members is inaccessible to vandals looking to remove the fabric.

Construction of a fence in accordance with the present invention also yields a much stronger fence that is known in the prior screening fence art. Since each fence panel is tightly secured not only to each I-beam but also to the fence panel on the opposite side of each I-beam by a through bolt, the entire fence essentially becomes one integral unit. A force directed against one panel or upright I-beam is partially distributed along the length of the fence. Thus, the fence is more likely to bend or deform rather that break apart to cause a further safety hazard.

The present design also allows for fences of various heights to be constructed by the simple stacking of the standard fence panels in higher I-beams. The importance of being able to use standard fence panels in a strong fence design is a major advantage of the present invention. Not only are all the problems associated with custom manufacture avoided, but using standard sized panels allows for easy, quick, and relatively inexpensive replacement of damaged sections. The design of the present invention allows each panel to be individually accessed and replaced without sacrificing the strength of the fence. In addition, in the preferred embodiment, the fabric material, the fence panel frames, and the I-beams can all have extensive and thorough whether resistant treatment before being assembled into the final fence.

The present design also allows for a novel mounting mechanism where it is necessary to accommodate the movement of an expansion point such as in a bridge. Right angle supports which fit inside of the open ends of the horizontal top and bottom fence frame members may be mounted onto the central section (webb) of the I-beam. The top and bottom horizontal frame members are then free to slide upon the right angle supports as the expansion joint expands and contracts. An additional guard panel attached to the flange of the I-beam prevents accidental intrusion into the moving system by curious hands, etc.

An alternative embodiment of the invention incorporates a strong cable extending the length of the fence. The cable may be passed through the top, bottom, or both horizontal fence panel frame members and passed from fence section to fence section through its own hole in the I-beam central support (webb). The cable not only adds structural integrity to the entire length of the fence by providing another mechanism to distribute the force of an impact along the entire fence, but also makes it impossible to remove any individual fence panel. A typical use for this feature would be for fencing required in a high security area.

Accordingly, an object of this invention is to provide fencing which is better able to withstand and distribute forces impacting the fence structure. A further object of this invention is to provide for easy maintenance and replacement of the fence components.

DETAILED DESCRIPTION OF THE PREFERRED EMBODIMENT OF THE INVENTION

Figure 1:
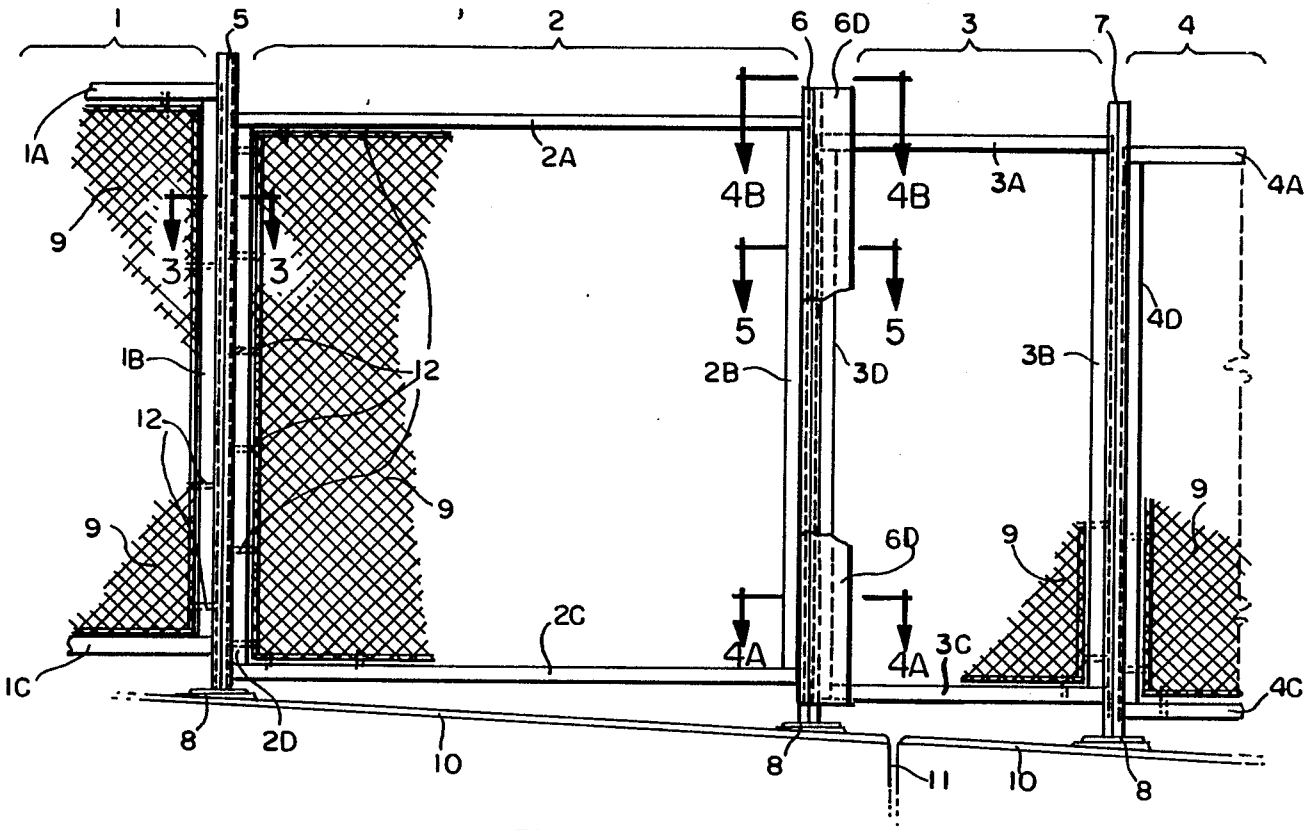
FIG. 1 shows a side view of adjacent fence sections including an expansion section.

FIG. 1 shows the fence of the present invention as it would be typically erected. Fence panels I, 2, 3, and 4 are disposed between vertical upright I-beams 5, 6, and 7. Vertical I-beams 5, 6, and 7 are shown mounted to base plates 8 which in turn are mounted on parapet 10. The fence is shown descending a slight grade as would be typical over a bridge which also has expansion point 11. Fence panels 1, 2, 3, and 4 are shown with fabric 9 attached to said panels by J bolts 12. Side frame member 1B of fence panel 1 abuts I-beam post 5 on one side while side frame member 2D of fence panel 2 abuts I-beam 5 on the opposite side from 1B. Similarly, side frame member 2B of fence panel 2 abuts I-beam 6. Side frame member 3D of fence panel 3 does not abut the opposite side of I-beam 6 but is suspended by the expansion joint design which will be described below. Side frame member 3B of fence panel 3 abuts I-beam 7 on one side while side frame member 4D of fence panel 4 abuts I-beam 7 on the other side. Guard panel 6D is shown attached to the side flanges of I-beam 6. Thus, each vertical I-beam post has two fence panels mounted to it. I-beam post 5, for example, has fence panels 1 and 2 mounted to it. Each fence panel in turn, is mounted to two posts. Thus, fence panel 2 is mounted to both I-beam post 5 and I-beam cost 6. This arrangement continues for the length of the fence so that all the posts and panels are linked in an integral structure. Because of this arrangement, a force impacting any part of the fence is distributed along its length.

FIG. 1 also shows the design and construction of the fence panels. In this embodiment, each fence panel has a surrounding frame made up of two horizontal and two vertical numbers. Thus, the frame of panel 2 is made up of top member 2A, bottom member 2C, and side members 2B and 2D. In a typical construction of the preferred embodiment, the fence panel frame members are solidly welded or attached where they meet at each corner. Each of the vertical I-beam posts 5, 6, and 7 is welded to its associated base plate 8. Base plates 8 are connected to the parapet by bolts mounted in the parapet.

Figure 2:
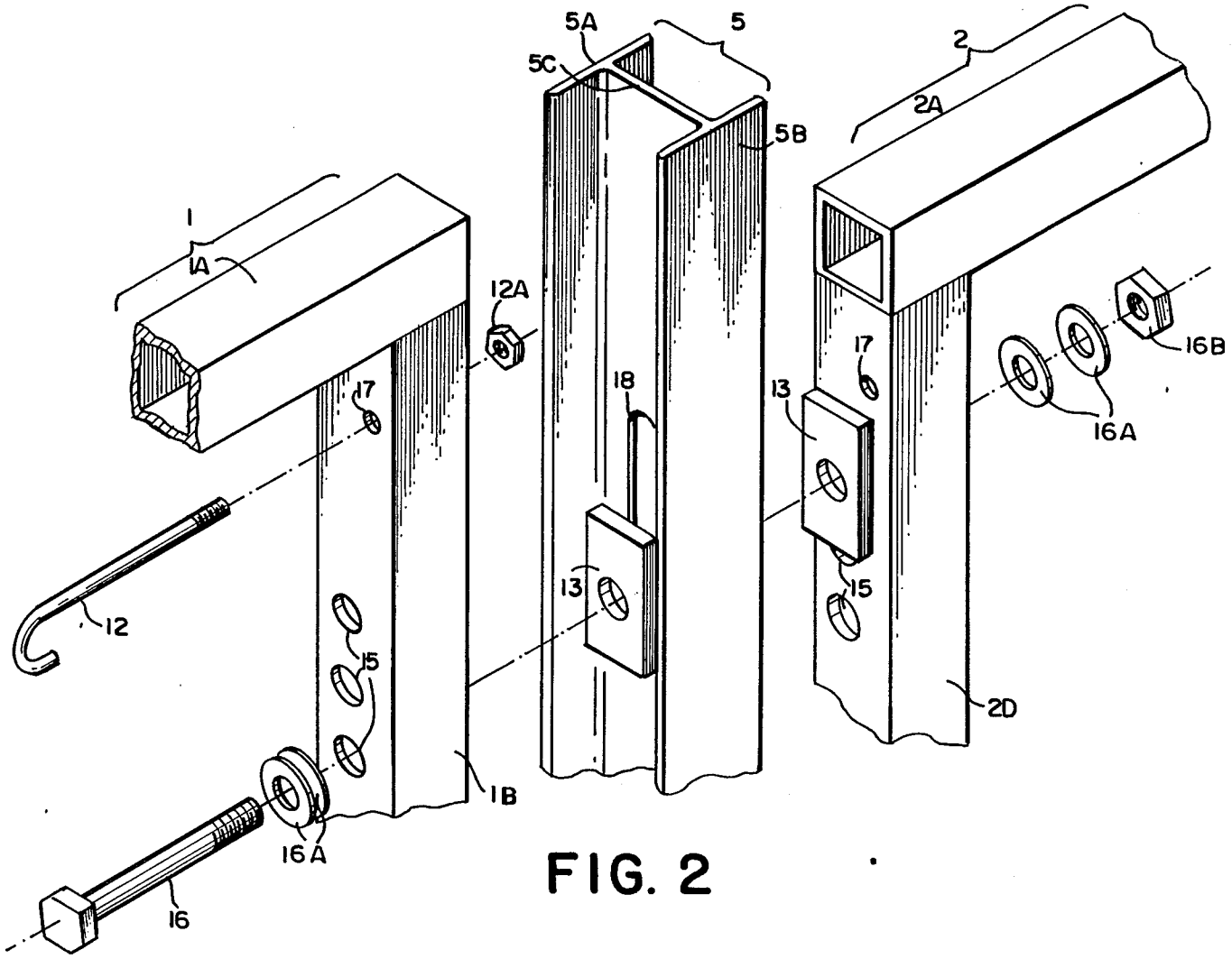
FIG. 2 is an exploded oblique view of a typical connection of fence panels through and to the I-beam support.

FIG. 2 shows more clearly in an exploded form the arrangement and fastening of the fence panel members to the I-beams. Disposed in fence panel vertical frame members 1B and 2D are a plurality of bolt holes 15 through which the fastening bolts 16 may pass. Similarly, in the central section (webb) 5C of the I-beam 5 there may be a plurality of holes or an elongated slot 18 through which the fastening bolt 16 may pass, In the preferred embodiment, the fence is assembled by passing bolt 16 through washers 16A then through vertical frame member 1B, through neoprene washer 13, through the central section (webb) 5C of the I-beam 5, through another neoprene washer 13, through holes 15 in vertical frame member 2D, through washers 16A to fastening nut 16B. During assembly fastening nut 16B is drawn tight upon bolt 16 forcing vertical frame members 1B and 2D into tight compressional contact with the I-beam post central section (webb) 5C to form a rigid structure. Neoprene washers 13 are disposed between the vertical frame members and the central section (webb) of the I-beam post in order to provide vibrational cushioning. It can be seen that the vertical frame members 1B and 2D fit within the side flanges 5A and 5B of the I-beam post 5. A J hook 12 which is typically used in the preferred embodiment to grasp and restrain the fabric material within the fence panel frames is mounted to the vertical frame members of the fence panels through holes 17 and fastened with nuts 12A. The fabric material is fastened with J bolts 12 and nuts 12A prior to the installation of the fence panel into the I-beam post. Similar J bolts and nuts may be used to fasten the fabric to the horizontal frame members. It can be seen that upon mounting the fence panel vertical frame member 1B against the I-beam post 5, access to nut 12A is effectively prohibited. Thus, vandals may not loosen nuts 12A in order to relieve the tension on fabric 9 applied by J bolts 12. This design, therefore, essentially vandal proofs the fabric of the fence panels. FIG. 2 also shows a typical situation where it is necessary to accommodate the fence to a slope. By providing in vertical frame members 1B and 2D a plurality of holes 15 and a slot 18 in the I-beam 5 through which bolt 16 may be passed, it is possible to adjust the relative heights of adjacent fence panels 1 and 2. In FIG. 2 it can be seen that bolt 16 passes through the lowest of holes 15 in vertical frame member 1B and the top hole in vertical member 2D. This results in fence panel 1 being at a different height than fence panel 2. There may be a plurality of bolts 16 connecting each two fence panels to each I-beam post, the number being determined by the strength desired in a given installation.

Figure 3:
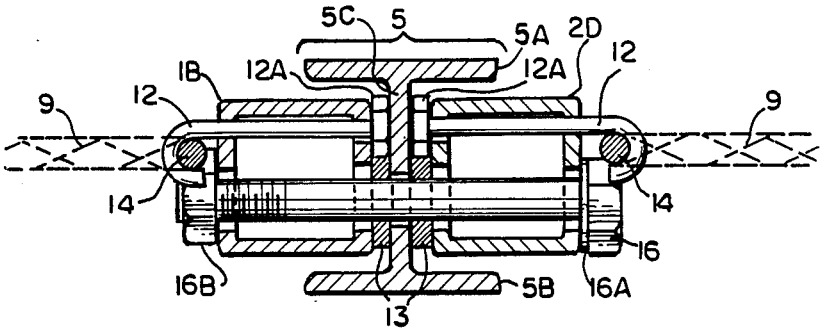
FIG. 3 shows an assembled cross-sectional view of a typical connection of fence panels through and to the I-beam support and also shows J bolt fabric mounting brackets.

FIG. 3 is a cross-sectional view of the assembled fence panels and I-beam post taken along line 3—3 of FIG. 1. Fence panel vertical frame members 1B and 2D are shown abutting the I-beam central support (webb) 5C having been drawn into tight compressional contact through neoprene washers 13 by bolt 16 and nut 16B. While fence panel vertical frame members 1B and 2D are not shown in contact with flanges 5A and 5B of I-beam post 5 in the drawing, it should be understood that the relative dimensions of the vertical frame members and the I-beam are construction details which would be determined for a given installation. Typically, for instance, vertical frame members 1B and 2D would not only be in tight compressional contact with the I-beam central support (webb) 5C but also in contact with either or both I-beam flange 5A or 5B. Also shown in FIG. 3 are the fabric mounting J bolts 12. The J bolts 12 are shown engaging stretcher rods 14 which in turn engage the fabric 9. J bolts 12 are fastened to vertical frame members 1B and 2D with nuts 12A prior to installation of the vertical frame members 1A and 2D within the I-beam 5. Fastening nuts 12A are trapped between the center support (webb) 5C of post 5 and vertical frame members 1B and 2D of the fence panels. It can be seen that nuts 12A are inaccessible to vandals in this arrangement. When the fence panels are assembled to the I-beam and brought into tight compressional contact with the I-beam, an integral structure is formed which is resistant to deformation under impact, and the force of such impact is spread along the length of the integrally joined fence sections. Therefore, a fence panel struck by a vehicle is less likely to break away from the fence and cause a safety hazard. Also, it can be seen that the central U-shaped groove formed by I-beam flanges 5A and 5B and central section (webb) 5C act to restrain the vertical frame members should the fence panels be struck by a vehicle. The effective capture of the vertical frame members by the I-beams decreases the likelihood even further that a fence panel will break away free if and when it is struck by a moving vehicle.

Figures 4, 4A, 4B:
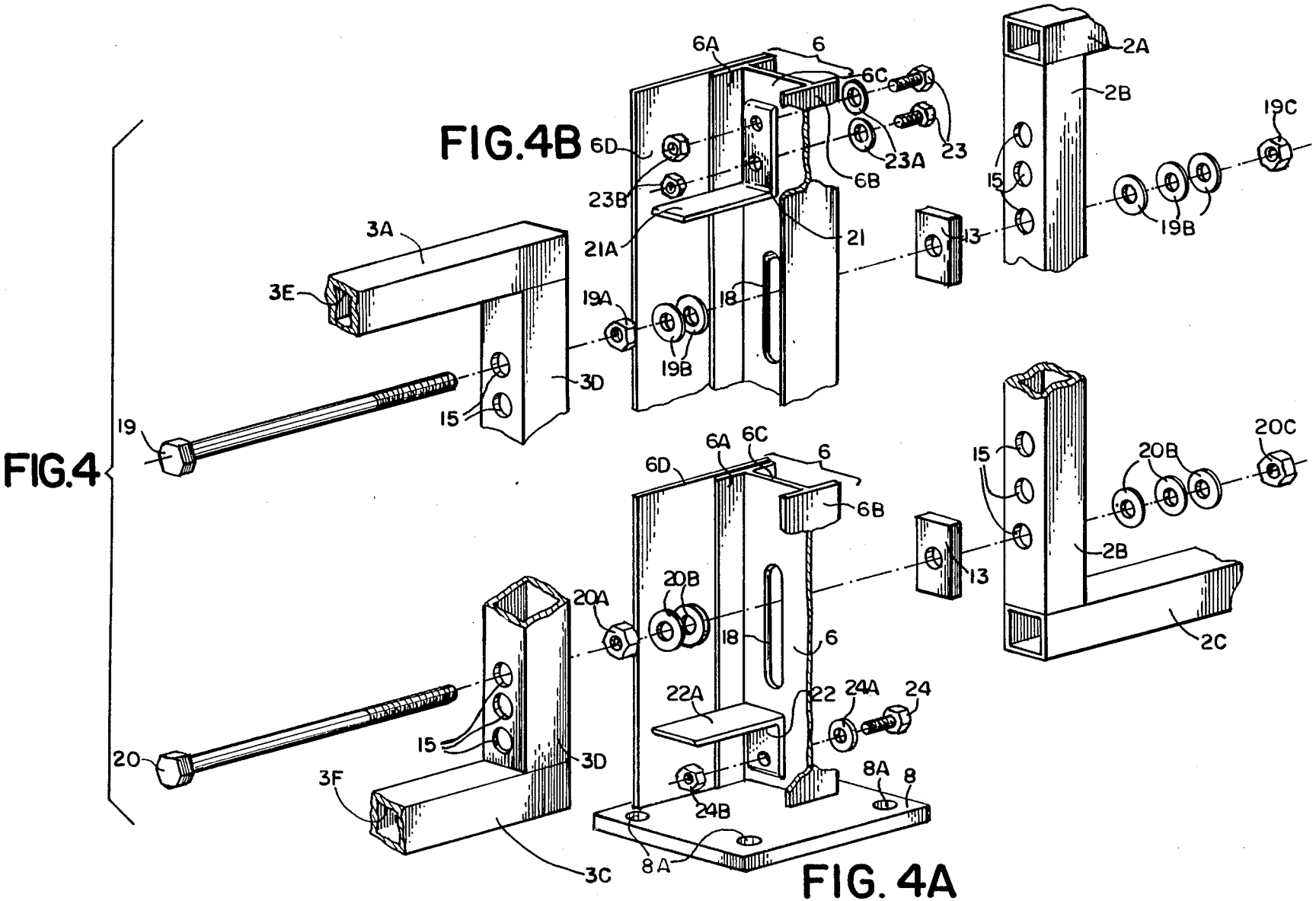
FIG. 4 is an exploded oblique view of an expansion mounting system for the fence panels showing an upper (4B) and lower (4A) assembly.

FIG. 4 shows the novel expansion mounting design of the present invention which permits a fence panel to move relative to an I-beam so that the fence may be placed on a bridge or similar structure that has expansion joints. FIG. 4A shows the lower expansion section taken along line 4A—4A in FIG. 1, while FIG. 4B shows the expansion section taken along line 4B—4B in FIG. 1. Both views in FIG. 4 are from the opposite side of the fence as shown in FIG. 1. As shown in FIG. 4, attached to the central section (webb) 6C of I-beam 6 are two right angle brackets, 21 and 22. These brackets are attached to the I-beam with bolts 23 and 24 and nuts 23B and 24B. The vertical spacing between the upper right angle bracket 21 and the lower right angle bracket 22 is adjusted so that the top surface 21A of right angle bracket 21 is in slidable contact with the inner surface 3E of upper horizontal frame member 3A at the same time that the top surface 22A of right angle bracket 22 is slidable contact with the inner surface 3F of horizontal frame member 3C. Horizontal frame members 3A and 3C are thus slidably mounted on right angle brackets 21 and 22. In the preferred embodiment, bolts 19 and 20 pass through holes 15 in vertical frame member 3D. Nuts 19A and 20A are advanced along towards the heads of bolts 19 and 20 so that a sufficient length of bolts 19 and 20 remain to pass through washers 19B and 20B, the central I-beam section 6C, neogrene washers 13, and vertical frame member 2B. Vertical frame member 2B is drawn into tight compressional contact with I-beam central section (webb) 6C by nuts 19C and 20C. The mounting compression of vertical frame member 2B to I-beam member 6C is achieved by tightening nuts 19C and 20C against nuts 19A and 20A respectively. The smooth shanks of bolts 19 and 20 extend from the I-beam. Vertical frame member 3D is left free to slidably move along the smooth shanks of bolts 19 and 20. The extent of the movement of frame member 3D upon bolts 19 and 20 is determined by the length of the shanks of bolts 19 and 20 which are shorter than the horizontal members of angle brackets 21 and 22. As can be seen from FIG. 1, one end of fence panel 3 is securely mounted to post 7 and fence panel 4 on one side of expansion joint 11. The other end of fence panel 3 is slidably mounted to I-beam post 6. I-beam 6 to which fence panel 2 is securely mounted is located on the other side of the expansion joint 11 from post 7. Therefore, as the horizontal dimension of the expansion joint changes, panel 3 is free to move upon angle brackets 21 and 22 and bolts 19 and 20. It is to be understood that additional bolts may be mounted through sections 3D, 6C, and 2B in a similar manner. Guard section 6D which is wide enough to cover the full range of movement permitted by the expansion system is welded to I-beam flange **6*a* to prevent access to the fence expansion system. Also shown in FIG. 4 is base plate 8 fastened to I-beam 6. Base plate 8 is shown with mounting holes 8*a*** through which fastening bolts located in the parapet may pass.

Figure 5:
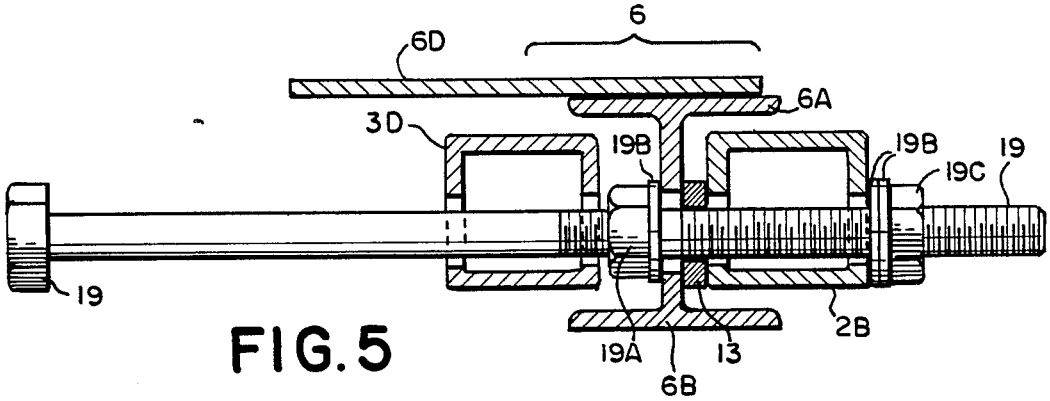
FIG. 5 shows an assembled cross-sectional view of an expansion mounting system for the fencing panels.

FIG. 5 shows a cross-sectional view of the expansion mounting system taken along line 5—5 in FIG. 1. It can be seen that vertical frame member 2B is mounted to I-beam 6 by compression between nuts 19A and 19C mounted on bolt 19. Vertical frame member section 3D is free to slide along the smooth shank of bolt 19.

Figure 6:
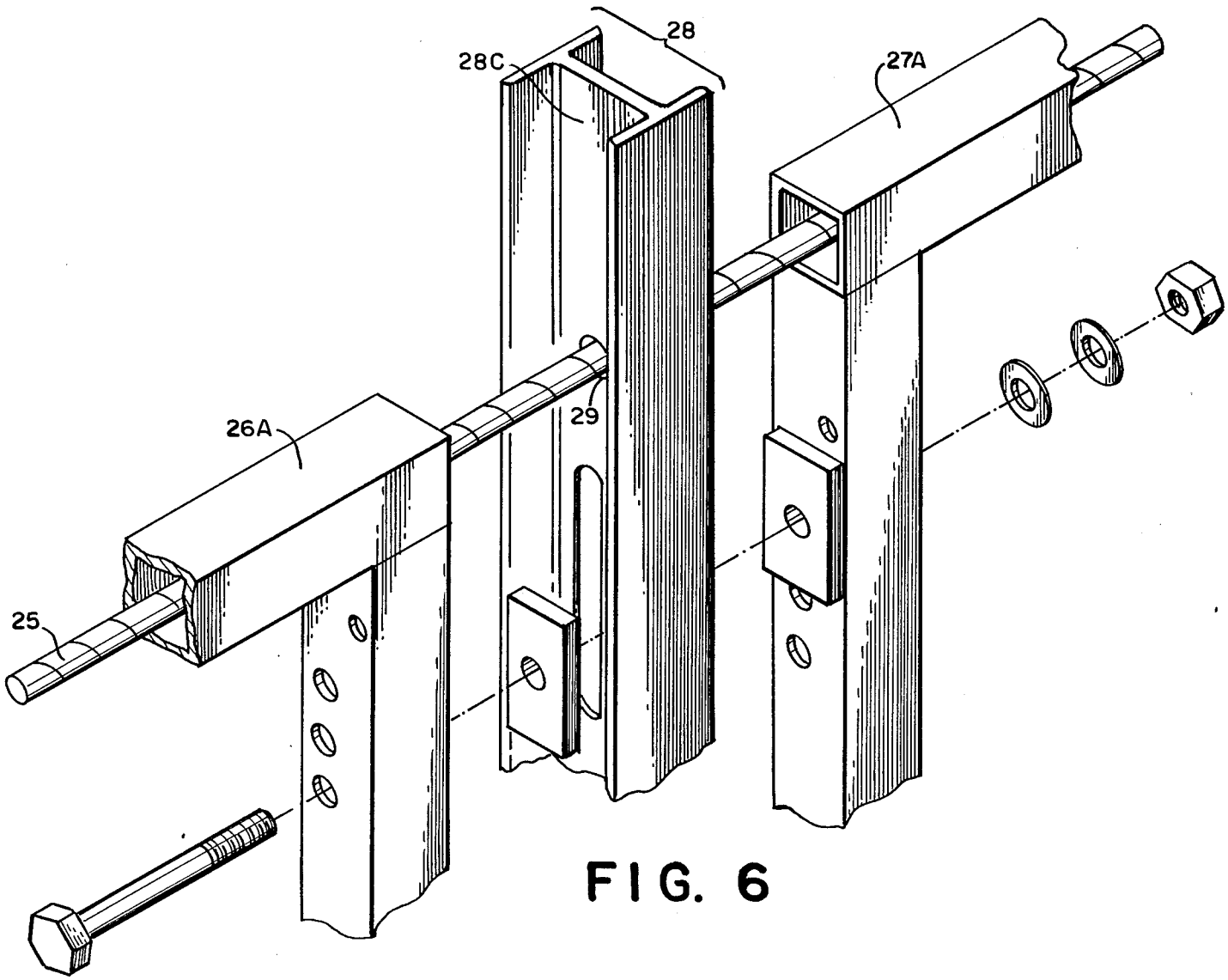
FIG. 6 shows an alternative embodiment of the invention with a cable passing through the fence panels and I-beam.

FIG. 6 shows an alternative embodiment of the present invention in which a cable 25 passes through an upper horizontal fence panel frame member 26A, then clearly through hole 29 located in the central support (webb) 28C of I-beam 28, thence through the upper horizontal frame member 27A of the adjoining fence panel. Once the fence is assembled with the cable running through the interior of the horizontal frame members, it is impossible to remove any fence panel. An additional cable may be run through the lower horizontal frame members. The cables may be terminated at the end I-beams in such a way that the cable terminating hardware is protected within the I-beam much like the J bolt ends. Further, the cable serves to distribute any impact force applied to one part of the fence structure along the entire length of the fence. With the cable, the fence structure is much more likely to bend and deform rather than break during impact loading.

While the discussion of the present invention has been in terms of using single fence panels mounted between each set of vertical I-beam supports, it can be seen that a fence of any height can be achieved by the simple expedient of stacking vertically additional panels between longer (higher) I-beam costs. These additional vertically stacked panels are mounted to the I-beam costs in the same manner as heretofore described both in the fixed and expansion joint versions. Restraining cables may be run through as many of the stacked panels as is required.

Further, because the fence is assembled from standard prefabricated parts, it is possible to rust proof or weather resistant treat the panels and the posts prior to assembling the fence. One typical method is to heat-fuse polyvinyl chloride onto the galvanized surface of the fence panel frame members and the I-beam posts as well as onto the fabric material used. several advantages of the design of the present invention over the prior art should be evident from the above description.

What is claimed is:

1. A fence comprising:

(a) a plurality of spaced vertical posts each of which comprises:
  (1) a central support;
  (2) at least two side supports; and
  (3) means for attaching said side supports to the central support to form a generally I-shaped configuration that defines channels on opposing sides of the central support wherein the posts are aligned with respect to each other such that the open sides of the opposing channels of each post face the open sides of the opposing channels of the other posts;

(b) a plurality of fence panels each of which is located between a pair of posts so that the ends of the fence panels are captured in the channels of each post to form a contiguous structure;

(c) means for supporting the posts; and (d) means for compressively fastening each fence panel to the central support of each contiguous post and, except at an end of the fence structure or at a post which may move with respect to another post, said means also fastening each fence panel to the fence panel contiguous to the opposite face of the central support of the contiguous post wherein the fence panels are linked to each other and to the posts to form an integral structure along the length of the fence.

2. The fence of claim 1 wherein the posts are I beams.

3. The fence of claim 1 wherein each fence panel further comprises:

(a) a frame, each member of which is rigidly connected to the two adjoining members;

(b) a fabric disposed within the area defined by the frame; and (c) means for fastening the fabric to the frame members which are captured in the channels of each post said fastening means thereby being vandal-resistant.

4. The fence panel of claim 3 wherein the frame is formed from hollow square tubing.

5. The fence panel of claim 3 wherein the frame is formed from round tubing.

6. The fence panel of claim 3 wherein the fabric is metal.

7. The fence panel of claim 6 wherein the fabric is chain link.

8. The fence panel of claim 3 wherein the means for fastening the fabric to the frame comprises:

(a) at least one curved bolt having a hooked end and a straight end in a J-shaped configuration which bolt is threaded on the straight end;

(b) at least one threaded nut adapted to thread onto the J-shaped bolt; and (c) at least one hole in a frame panel member wherein the hook end of said curved bolt engages the fabric, the straight end of said curved bolt passes through the hole in the frame member, and the threaded nut secures the curved bolt to the frame member, said nut being on the side of the frame member which faces the central support of the post.

9. The fence of claim 1 wherein the means for compressively fastening each fence panel to the central support of each contiguous post and to the fence panel contiguous to the opposite face of the central support of the contiguous post further comprises:

(a) a plurality of threaded fastening bolts;

(b) a plurality of threaded nuts adapted to thread onto said bolts;

(c) a plurality of holes in the fence panel frame members; and (d) a plurality of holes in the central support of each post wherein the bolts pass from the inside of the fence panel frame member contiguous with one side of the post central support through a hole in the fence panel frame member, through a hole in the post central support, through a hole in the fence panel frame member contiguous with the opposite side of the post central support and into a fastening nut.

10. The fence of claim 1 further comprising means for movably connecting a fence panel compressively fastened at one end to a first fixed post, to a second post to accommodate changes in interpost distance caused by movement of said second post.

11. The fence of claim 10 wherein the means for movably connecting a fence panel compressively fastened at one end to a fixed post, to a second movable post comprises:

(a) at least one horizontal fence panel frame member having an opening on at least one end;

(b) at least one right angle bracket adapted to slidably engage the open end of the horizonatal fence panel frame member;

(c) means for fastening the at least one right angle bracket to the post;

(d) at least one threaded bolt;

(e) at least one threaded nut adapted to thread onto said bolt;

(f) guard means for preventing access to the open ends of the fence panel frame members and the right angle brackets wherein the open end of the horizontal fence panel frame members rest upon the right angle brackets which thereby support the end of the fence panel so that during movement of the post the fence panel slides on the angle bracket and wherein the bolt passes from the inside of the fence panel frame member through a hole in the fence panel frame member, through a first nut, through a hole in the post central support, through a hole in the fence panel frame member contiguous with the opposite side of the post central support and into a second fastening nut such that the fence panel frame member freely slides over the bolt which acts to prevent the fence panel frame member from slipping off of the right angle bracket, while at the same time the fence panel contiguous to the opposite side of the post central support is compressively fastened to the post by the nuts and bolt.

12. The fence of claim 10 wherein the means for movably connecting a fence panel compressively fastened at one end to a first fixed post, to a second movable post comprises:

(a) at least one support member attached to the movable post; and (b) means attached to the fence panel for slidably engaging the support member.

13. The means for movably connecting a fence panel compressively fastened at one end to a first fixed post, to a second movable post of claim 12 further comprising means for limiting the movement of the fence panel.

14. The means for movably connecting a fence panel compressively fastened at one end to a first fixed post, to a second movable post of claim 12 further comprising guard means for preventing access to said support member and means for slidably engaging the support member.

15. The fence of claim 1 further comprising means for simultaneously preventing the removal of any fence panel from the fence and binding the fence together in one integral structure.

16. The fence of claim 15 wherein the means for simultaneously preventing the removal of any fence panel from the fence and further binding the fence together in one integral structure comprises a cable anchored at each end which passes through a horizontal fence panel frame member of a first fence panel, through a hole in the first central support post, through a horizontal fence panel frame member of the next fence panel and so on through all fence panels and posts.

17. A fence comprising:

(a) a plurality of posts having an "I" beam cross section having opposing channels;

(b) a plurality of panels having end members, said end members positioned within said opposing channels of said posts;

(c) means for supporting said posts; and (d) means for compressively fastening said panel members to one another and for compressively fastening said panel members to said posts whereby the combination of said panel members and said posts cooperate to resist bending moments caused by impact to the fence.

* * * * *